US009598814B2

(12) United States Patent
Manninen

(10) Patent No.: US 9,598,814 B2
(45) Date of Patent: Mar. 21, 2017

(54) DOUBLE PIN SEAMING ELEMENT

(71) Applicant: AstenJohnson, Inc., Charleston, SC (US)

(72) Inventor: Allan R. Manninen, Stittsville (CA)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 14/906,186

(22) PCT Filed: Aug. 20, 2014

(86) PCT No.: PCT/CA2014/000641

§ 371 (c)(1),
(2) Date: Jan. 19, 2016

(87) PCT Pub. No.: WO2015/024107

PCT Pub. Date: Feb. 26, 2015

(65) Prior Publication Data

US 2016/0160435 A1 Jun. 9, 2016

(30) Foreign Application Priority Data

Aug. 20, 2013 (CA) ..... 2824609

(51) Int. Cl.
*D21F 7/10* (2006.01)
*D06H 5/00* (2006.01)
*D21F 1/00* (2006.01)

(52) U.S. Cl.
CPC ..... *D06H 5/00* (2013.01); *D21F 1/0054* (2013.01); *D21F 7/10* (2013.01)

(58) Field of Classification Search
CPC ..... Y10T 428/192; Y10T 428/24198; Y10S 162/904; D21F 1/0054
(Continued)

(56) References Cited

U.S. PATENT DOCUMENTS 5,746,257 A 5/1998 Fry
9,194,082 B2 * 11/2015 Manninen ..... F16G 3/04
2014/0199510 A1 * 7/2014 Manninen ..... D21F 1/0054 428/61

FOREIGN PATENT DOCUMENTS

WO 2011/100157 A1 8/2011
WO 2013/086609 A1 6/2013

OTHER PUBLICATIONS

International Search Report and Written Opinion dated Sep. 22, 2014 for International Application Serial No. PCT/CA2014/000641, International Filing Date: Aug. 20, 2014, consisting of 10 pages.

* cited by examiner

*Primary Examiner* — Alexander Thomas
(74) *Attorney, Agent, or Firm* — Christopher & Weisberg, P.A.

(57) ABSTRACT

A seaming element for an industrial textile, and methods of manufacture. The seaming element body is constructed from a single layer of polymeric film that is folded to provide a fold region and arms that comprise a first region, and a further second region. The first region is bonded to surfaces of an edge region of the textile, while the second region comprises a plurality of spaced-apart aligned protrusions extending from the first region, each protrusion comprising an interior space defined by an upper layer; a lower layer; and a loop at the fold region that connects the upper and lower layers. The interior space is divided into an outer securing region and an inner securing region by either a rib member placed between and bonded to an inner surface of at least one of the upper and lower layer, or by bonding a portion of the upper layer with a portion of the lower layer at a constriction zone. The outer securing region is interdigitatable and alignable with the inner securing region of a corresponding second seaming element bonded to another
(Continued)

region of the textile, to define a first channel; and the inner securing region is interdigitatable and alignable with the outer securing region of the corresponding second seaming element, to define a second channel. A securing element is placed in the two channels.

16 Claims, 19 Drawing Sheets

DOUBLE PIN SEAMING ELEMENT

CROSS-REFERENCE TO RELATED APPLICATIONS

This application is a submission under 35 U.S.C. §371 for U.S. National Stage Patent Application of, and claiming priority to, International Application Number PCT/CA2014/000641, filed Aug. 20, 2014, entitled "DOUBLE PIN SEAMING ELEMENT", which International Application is related to and claims priority to Canadian Application Serial No.: 2,824,609, filed Aug. 20, 2013, the entire contents of both of which are hereby incorporated herein by reference.

TECHNICAL FIELD

This invention relates to industrial textiles, and in particular to a double pin seaming element and a method of seaming of industrial textiles.

BACKGROUND

Prior art seaming elements (e.g. WO 2010/121360 (Manninen)) can include nonwoven seaming elements which are formed from an oriented polymer film. One of a pair of such seaming elements can be attached at each end or edge of a textile to be joined, and looped portions at the free edge regions of the two elements can be interdigitated to provide a channel suitable for receiving a securing means such as a pintle. The dimensions for the seaming elements are selected so as to be compatible with the textile to be seamed, in particular as to thickness so as to minimize or avoid any discontinuity at the seaming area.

For the manufacture of such seaming elements, it is also known to use conventional methods of roll-forming, such as that disclosed in WO 2014/075170 (Manninen).

It is also known from WO 2011/100157 (Breuer et al.) to provide a double set of loops constructed from warp yarns in the seaming area of a woven fabric, through each of which sets a pintle can be inserted. However, the double set of loops are connected to and integral with the body of the entire fabric, and there is no suggestion of providing a distinct and separate seaming element unit for later attachment to a variety of types of industrial textile, woven or non-woven, single layered or multilayered.

It is also known from WO 2013/086609 (Manninen) that such a separate seaming element can be constructed so as to provide two or more looped regions, thereby creating at least two channels across the seam, which allows for improved distribution of the tensile load across the element.

Such channels can be dimensioned so as to provide sufficient space in which the free ends of pintles can be turned back into the channel to secure the ends. These seaming elements can be secured to the seamable end or edge of the textile by any suitable means, including bonding, either to compressed yarn ends of a woven textile, or to appropriate selected surfaces of a non-woven textile, including a textile comprising one or more layers of film. The elements are constructed from two folded layers of film, one secured inside the other, or as a molded structure having the same cross-section as the two layer construction.

In addition, EP 2511567 (B1) (Frey) discloses a method for manufacturing a strip of material in a loop. The method includes the steps of splitting each of ends of a conveyor belt in order to separate an upper face from a lower face of the belt. In each zone, transverse holes are formed. A transverse pin is then arranged in each zone. The upper and lower faces of the belt are then put back together, and the pin is removed.

It has now been found that two channels can be provided in a structure comprising a single folded layer of film.

SUMMARY

According to one aspect of the present invention, there is provided a seaming element for seaming a first seamable edge region of an industrial textile to a second seamable edge region of the industrial textile, the seaming element constructed from a single layer of polymeric film folded to provide a fold region and arms that comprise a first region, the seaming element further comprising a second region, i) the first region is constructed and arranged to be bonded to a first and second surface of the first seamable edge region; and ii) the second region comprises a plurality of spaced-apart aligned protrusions extending from the first region, each protrusion comprising an interior space defined by an upper layer; a lower layer; and a loop at the fold region that connects the upper and lower layers; wherein: (A) the interior space is divided into an outer securing region and an inner securing region by either: a) a rib member placed between and bonded to an inner surface of at least one of the upper and lower layer; or by b) bonding a portion of the upper layer with a portion of the lower layer at a constriction zone; the outer securing region defined in part by an inner surface of the loop; (B) the outer securing region is interdigitatable and alignable with the inner securing region of a corresponding second seaming element bonded to the second seamable edge region of the textile, to define a first channel; and (C) the inner securing region is interdigitatable and alignable with the outer securing region of the corresponding second seaming element, to define a second channel.

According to a further aspect of the present invention, there is provided a seaming element for seaming a first seamable edge region of an industrial textile to a second seamable edge region of the industrial textile, the seaming element constructed from a single layer of biaxially-oriented polymeric film folded in a general U-shape to provide a fold region and parallel first and second regions; i) the first region is constructed and arranged to be bonded to a first and second surface of the first seamable edge region; and ii) the second region comprises a plurality of spaced-apart aligned protrusions extending from the first region, each protrusion comprising an interior space defined by an upper layer; a lower layer; and a loop at the fold region that connects the upper and lower layers; wherein: (A) the interior space is divided into an outer securing region and an inner securing region by either: a) a rib member placed between and bonded to an inner surface of at least one of the upper and lower layer; or by b) bonding a portion of the upper layer with a portion of the lower layer at a constriction zone; the outer securing region defined in part by an inner surface of the loop; (B) the outer securing region is interdigitatable and alignable with the inner securing region of a corresponding second seaming element bonded to the second seamable edge region of the textile, to define a first channel; and (C) the inner securing region is interdigitatable and alignable with the outer securing region of the corresponding second seaming element, to define a second channel.

The polymeric film may initially be in the form of a film strip, which is subsequently bent in to form a U-shape.

In one exemplary embodiment, the interior space can be divided by the rib member that is bonded to the inner surface of the upper layer and the inner surface of the lower layer, by a process such as welding or adhesive bonding, though it will be understood that variations to this could be effected. The rib members may have a configuration of a monofilament or a thin strip or sheet of film. The monofilament or strip can have similar characteristics to those of the seaming element body, but should have a thickness no greater than to that of a compressed edge region of the fabric so as to minimize any discontinuity or unevenness in the surface of the seaming element body.

In another exemplary embodiment, the interior space is divided into an outer and inner securing region by the constriction zone, with the constriction zone comprising at least one ridge on an inner surface of at least one of the upper layer and the lower layer, whereby each ridge is bonded to an inner surface of the opposing layer. Optionally, the constriction zone may have ridges on inner surfaces of both the upper layer and the lower layer. In bonding the ridges to the opposing layer, a process such as welding and/or adhesive bonding can be used.

Each of the first and second channels can be constructed and arranged to receive a securing means, such as a pintle, therethrough to secure them together.

The polymeric film of the seaming element may comprise either a thermoplastic material or a thermoset material.

The thermoplastic polymer can be a material such as polyethylene terephthalate (PET), polybutylene terephthalate (PBT), polyethylene naphthalate (PEN), poly(cyclohexylene dimethylene terephthalate), acid (PCTA), polyphenylene sulphide (PPS), polyetheretherketone (PEEK), a polysulfone or a polyamide. The polymeric film may be coated with, or comprise, a laser energy absorbing dye. When a thermoplastic polymer is used, the polymeric film can be biaxially oriented film. Furthermore, the biaxially oriented film can be a bicomponent PET film having a layer that can be welded by laser. The film material can be a bi-axially oriented bi-component film, as described in WO 2013/071419 (Manninen). If the film material is a polyester, it can be hydrolysis-stabilized so as to be resistant to thermal and hydrolytic degradation. One suitable such material is described, for example, in WO 2013/177670 (Manninen). In one embodiment, the thermoplastic film material comprising the seaming element can be PET, which can have an intrinsic viscosity that is in the range of from about 0.55 to about 1.0 or more; or in the range of from about 0.6 to about 0.8. When a thermoplastic polymer is used, the seaming element can be bonded to the industrial textile using laser welding.

Alternatively, the film material can be a thermoset polymer such as a polyimide. Thermoset polymers are not amenable to laser welding, and thus can be secured in place by use of an appropriate adhesive or other bonding method. Thermoset polymers that may be suitable include commercially available polyimides which are sold in the marketplace under the tradenames Apical™, Kapton™, UPILEX™, VTEC PI™, Norton TH™ and Kaptrex™ though it will be understood that variations to this are possible.

The seaming element can be bonded to a woven industrial textile such that the first and second seamable edge regions each comprise a compressed textile region, and the first region of the seaming element is constructed and arranged to be bonded to portions of a first and second outer surface of the compressed textile region.

Alternatively, the seaming element can be bonded to a non-woven industrial textile comprising one or more layers of a non-woven fibrous or film material, such that the first and second seamable edge regions each comprise a compressed textile region, and the first region of the seaming element is constructed and arranged to be bonded to portions of a first and second outer surface of the compressed textile region.

There is further provided an industrial textile comprising at least one pair of seaming elements, each comprising at least two securing regions, as described herein.

In an exemplary embodiment, the industrial textile is a woven textile comprising yarns, having first and second seamable edge regions that each comprise a compressed textile region, and the second lateral edge region of the seaming element is constructed and arranged to be securable at portions of an inner surface to the compressed textile region. The seaming elements can each be bonded to the industrial textile by welding or adhesive bonding. It is to be understood however, that where the seaming element is to be secured to the yarns by laser welding, it must have suitable optical properties so as to be transparent to the incident laser radiation, and for this aspect, a bi-component film including a thin layer of laser energy absorbent as described in WO 2013/071419 (Manninen) can be used; the laser energy absorbent component may be provided to the interior or exterior of the seaming element. Alternatively, the seaming element, the yarn ends of the textile, or a film insert can be coated with a suitable laser energy absorbing dye. Where the seaming element is expected to be exposed to high heat and humidity during use, a hydrolysis stabilized biaxially oriented multilayer thermoplastic film comprising PET is particularly suitable. Such a film is described in WO 2013/177670 (Manninen). In instances where it is not practical to laser weld a seaming element comprised of a thermoplastic film material such as PET to the textile, it is also possible, in an alternative embodiment, to use a thermoset plastic film or component for this purpose as has been previously described.

According to yet another aspect of the present invention, there is provided a method of providing a seaming element for seaming a first seamable edge region of an industrial textile to a second seamable edge region of the industrial textile, the method comprising the steps of (a) providing an elongated strip of substantially planar polymeric film having opposed substantially parallel linear edges, an edge region adjacent each edge, and a central region connecting the edge regions; (b) securing a rib member longitudinally to the elongated strip in the central region at a location offset from a center line of the elongated strip; (c) selectively cutting the elongated strip along the central region and the rib to provide land areas having portions of the rib secured thereto, and at least a first array of regularly spaced apertures, the apertures comprising mutually parallel slots oriented in a direction normal to the linear edges of the strip; (d) bringing the opposed linear edges towards each other in mutual alignment to align the edge regions with each other to form a seaming element body and to align outer surfaces of the secured portions of the rib with opposing land areas, and to configure extended portions of the land areas into a plurality of regularly spaced seaming loops to form an outer securing region; (e) securing the portions of the rib to the opposing land areas to form an inner securing region; and (f) selectively cutting a length of the elongated strip to provide the seaming element.

There is further provided a method of providing a seaming element for seaming a first seamable edge region of an industrial textile to a second seamable edge region of the industrial textile, the method comprising the steps of (a) providing an elongated strip of substantially planar polymeric film having opposed substantially parallel linear edges, an edge region adjacent each edge, and a central region connecting the edge regions; (b) feeding the planar material between a plurality of opposed rolls in a progressive roll forming process to provide a profile to at least one of the edge regions, and to provide a profile to at least one constriction zone at a location in the central region and offset from a center line of the elongated strip; (c) before or after step (b), selectively cutting the elongated strip along the central region including the constriction zone to provide land areas defining at least a first array of regularly spaced apertures, the apertures comprising mutually parallel slots oriented in a direction normal to the linear edges of the strip; (d) bringing the opposed linear edges towards each other in mutual alignment to align the edge regions with each other to form a seaming element body and to align the at least one constriction zone profile with opposing ones of the land areas, and to configure extended portions of the land areas into a plurality of regularly spaced seaming loops to form an outer securing region; (e) securing the at least one constriction zone profile to the opposing ones of the land areas to form an inner securing region; and (f) selectively cutting a length of the elongated strip to provide the seaming element.

Step (b) may comprise providing a profile to a first and second constriction zone that are each equidistant from the center line of the elongated strip, and step (e) comprises securing the first constriction zone profile to the second constriction zone profile.

In each of the methods, step (a) may comprises providing a film material of at least one layer constructed of the materials noted above.

In yet a further aspect of the present invention, there is provided a method of providing a seam for an industrial textile, comprising the steps of (a) preparing an opposed pair of seamable edges of the textile; (b) providing and securing to each of the seamable edges a seaming element as defined above; (c) bringing the seaming elements and seamable edges together, interdigitating respective ones of the protrusions to align the outer securing region of a first of the seaming elements with the inner securing region of the second of the seaming elements to define a first channel, and to align the inner securing region of the first of the seaming elements with the outer securing region of the second of the seaming elements to define a second channel; and (d) inserting at least one securing means in each of the first channel and the second channel to secure the seam.

In this embodiment the securing in step (b) may be performed by a bonding process such as laser welding or application of at least one adhesive. In addition, the securing means can be a pintle, and step (d) can comprises for each of the first channel and the second channel, (d.1) providing the pintle in a length exceeding a length of the seam and inserting it to protrude from each end of the respective channel;

(d.2) bending proportions of the pintle adjacent the respective channel; and (d.3) inserting a free end of each protruding portion of the pintle into the channel to secure the seam.

The foregoing summarizes the principal features of the double pin seaming element and some of its optional aspects. The double pin seaming element may be further understood by the description of embodiments which follow.

Wherever ranges of values are referenced within this specification, sub-ranges therein are intended to be included within the scope of the double pin seaming element unless otherwise indicated. Where characteristics are attributed to one or another variant of the double pin seaming element, unless otherwise indicated, such characteristics are intended to apply to all other variants of the double pin seaming element where such characteristics are appropriate or compatible with such other variants.

DETAILED DESCRIPTION OF THE DRAWINGS

The following is given by way of illustration only and is not to be considered limitative of the double pin seaming element. Many apparent variations are possible without departing from the spirit and scope thereof.

Figure 1:
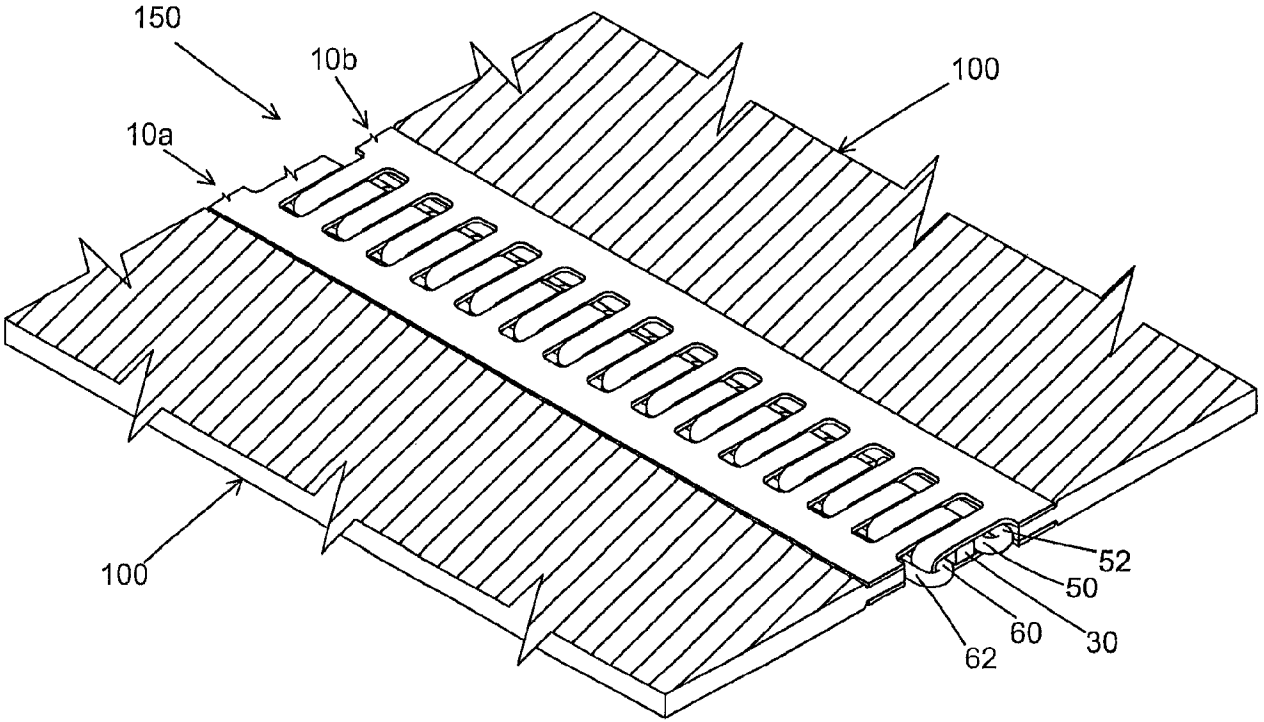
FIG. 1 is a perspective view of a first embodiment of a pair of double pin seaming elements.
Figure 2:
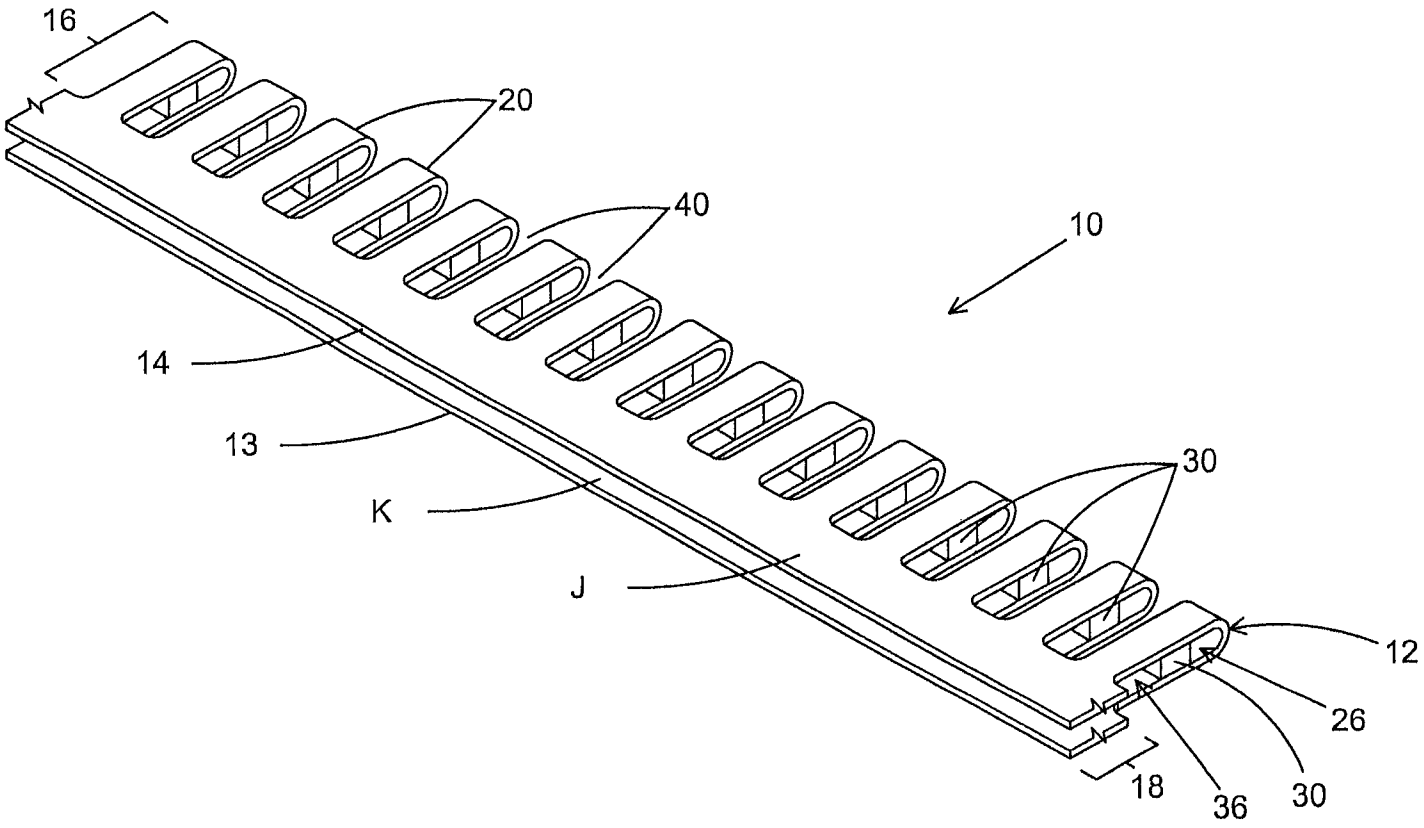
FIG. 2 is a perspective view of a first embodiment of one double pin seaming element.
Figure 3:
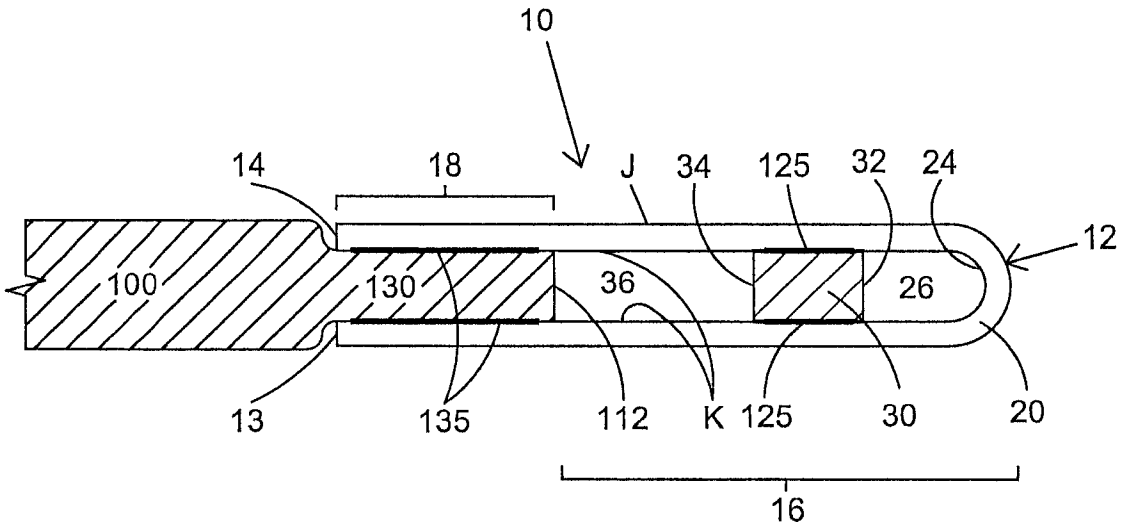
FIG. 3 is a side view of the double pin seaming element shown in FIG. 2.

Referring first to FIGS. 1 to 3, a first embodiment of the double pin seaming element is shown in two perspective views and a side view respectively, comprising seaming element 10, shown in FIG. 1 as a joined pair of seaming elements 10*a*, 10*b*. As best seen from FIG. 2, seaming element 10 has a rear (first) region 18 with upper trailing edge 14 and lower trailing edge 13, a forward (second) region 16 comprising an array of looped protrusions 20, extending from the rear (first) region 18 to fold line 12, and separated by apertures 40. Between upper and lower layers of each of protrusions 20 ribs 30 are secured so as to provide a first space 26 within the fold area at fold line 12, and a second space 36 between ribs 30 and rear (first) region 18. Referring to FIG. 3, it can be seen that ribs 30 are bonded at bond regions 125 to inner surfaces K of protrusions 20. Fabric 100, which may be a woven or nonwoven textile and includes a compressed or reduced thickness area 130, is secured within rear (first) region 18 and is bonded at bond regions 135 to inner surfaces K to secure seaming element 10 to fabric 100. This provides an outer securing region including a first closed channel (at 26) defined by inner surface 24 of the loops of protrusions 20 and leading surface 32 of rib 30, and an inner securing region including a second closed channel (at 36) defined by trailing surface 34 of rib 30, inner surfaces K of protrusions 20, and leading surface 112 of compressed region 130 of fabric 100. Referring to FIG. 1, a pair of seaming elements 10*a*, 10*b* is shown attached to respective ends of fabric 100 in the manner shown in FIG. 3, and joined to each other. This is effected by aligning protrusions 20 of seaming element 10*a* with apertures 40 of seaming element 10*b*, and aligning protrusions 20 of seaming element 10*b* with apertures 40 of seaming element 10*a*, so that the outer securing region including first closed channel 26 in seaming element 10*a* is aligned with the inner securing region including second closed channel 36 in seaming element 10*b*, and the outer securing region including first closed channel 26 in seaming element 10*b* is aligned with the inner securing region including second closed channel 36 in seaming element 10*a*. This alignment of the securing regions allows for the insertion of a securing means such as pintles 50, 60 into the first and second channels 26 and 36, and for the ends of the pintles 52, 62 (known as pintle tails) to be inserted in the adjacent spaces as shown.

Figure 4:
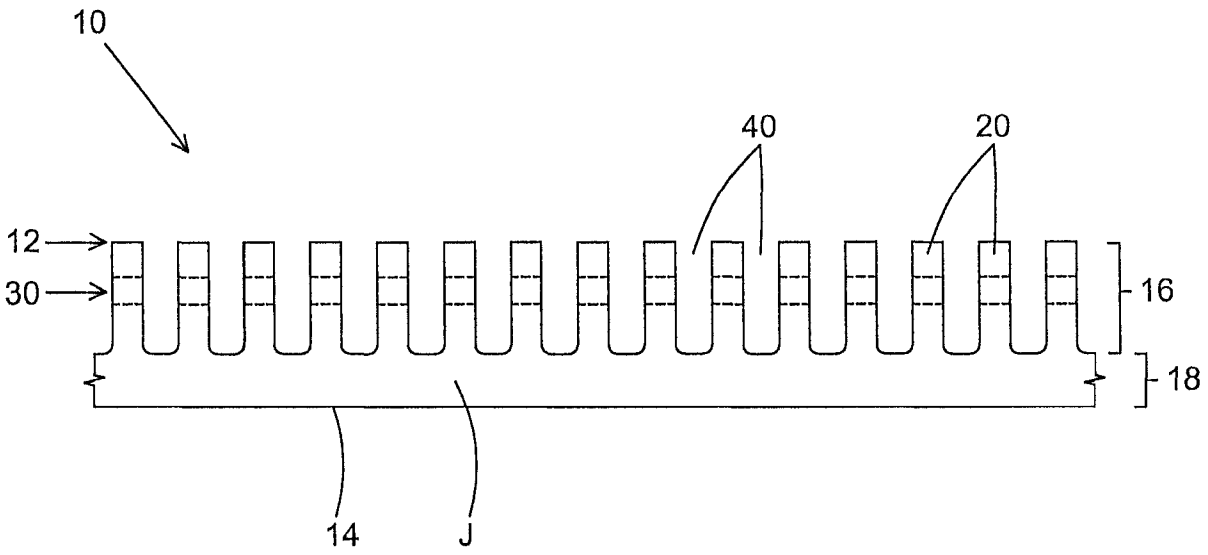
FIG. 4 is a top view of the double pin seaming element shown in FIGS. 2 and 3.

FIG. 4 is a top view of the seaming element shown in FIGS. 2 and 3, showing the location of ribs 30 in each of protrusions 20. The position of the ribs 30, relative to the fold line 12 or trailing edges 13 and 14, may be adjusted as required.

Figure 5:
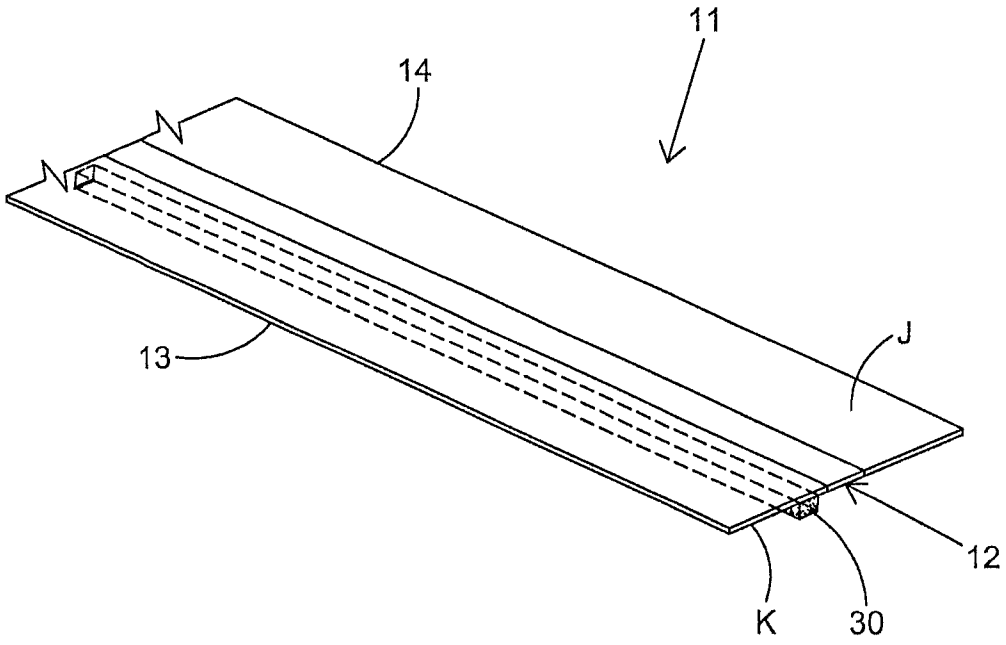
FIG. 5 is a perspective view of a planar seaming element blank for use in forming the double pin seaming elements of FIGS. 1-4.
Figure 6:
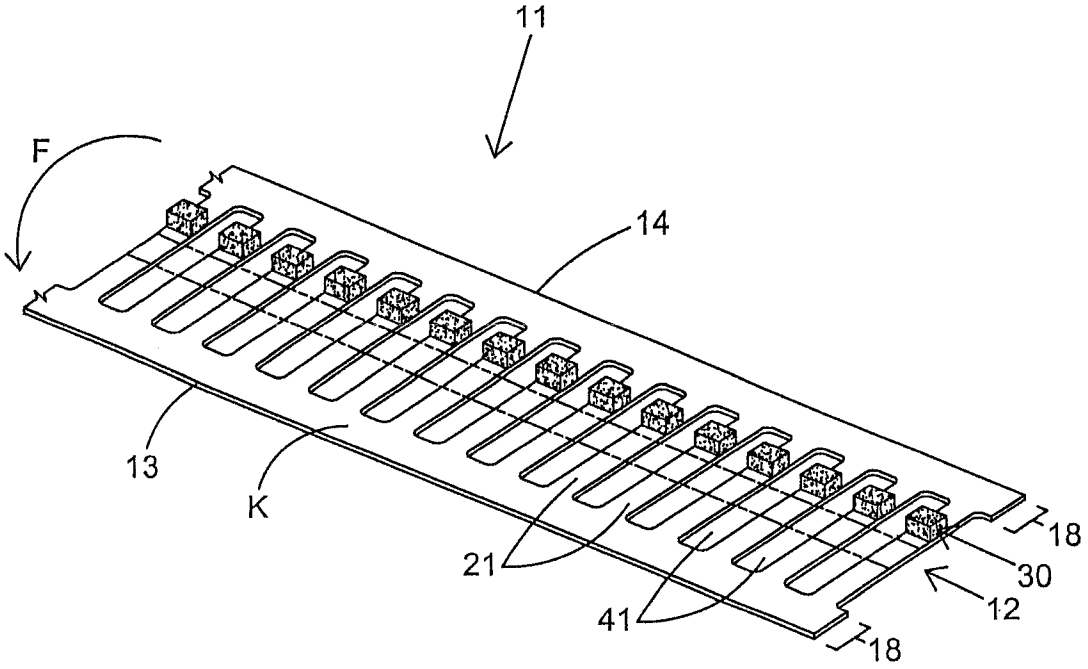
FIG. 6 is a perspective view of the blank shown in FIG. 5, after cutting of the blank.

Referring to FIGS. 5 and 6, these are perspective views of a planar seaming element blank 11 for use in forming the seaming elements of FIGS. 1 to 4, and blank 11 after cutting in preparation for folding along fold line 12. FIG. 5 shows the eventual outer surface J of blank 11, and initially continuous rib material such as a monofilament or strip of film attached to eventual inner surface K for ribs 30. As can be seen from the inverted view in FIG. 6, blank 11 is then cut to form land areas 21 which will become protrusions 20 after folding, separated by apertures 41, which will become apertures 40 after folding. The cutting step removes sections of the continuous material leaving discrete portions of ribs 30 secured to each of land areas 21. When the blank is folded in the direction F, bringing upper trailing edge 14 into alignment with lower trailing edge 13 to align regions 18 with each other, land areas 21 become protrusions 20, and each rib 30 is aligned with a corresponding location on the opposing layer of the respective protrusion 20, as seen in FIG. 2.

Figure 7:
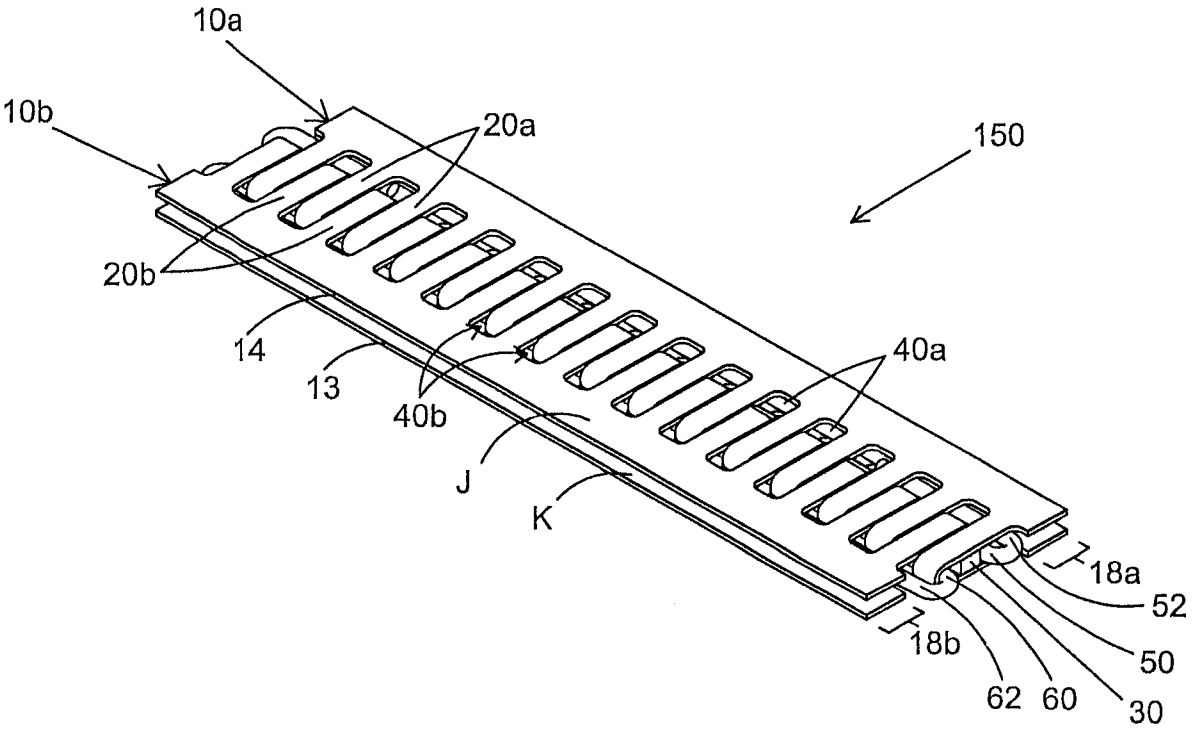
FIG. 7 is a perspective view of a pair of double pin seaming elements as shown in FIGS. 1 to 4.
Figure 8:
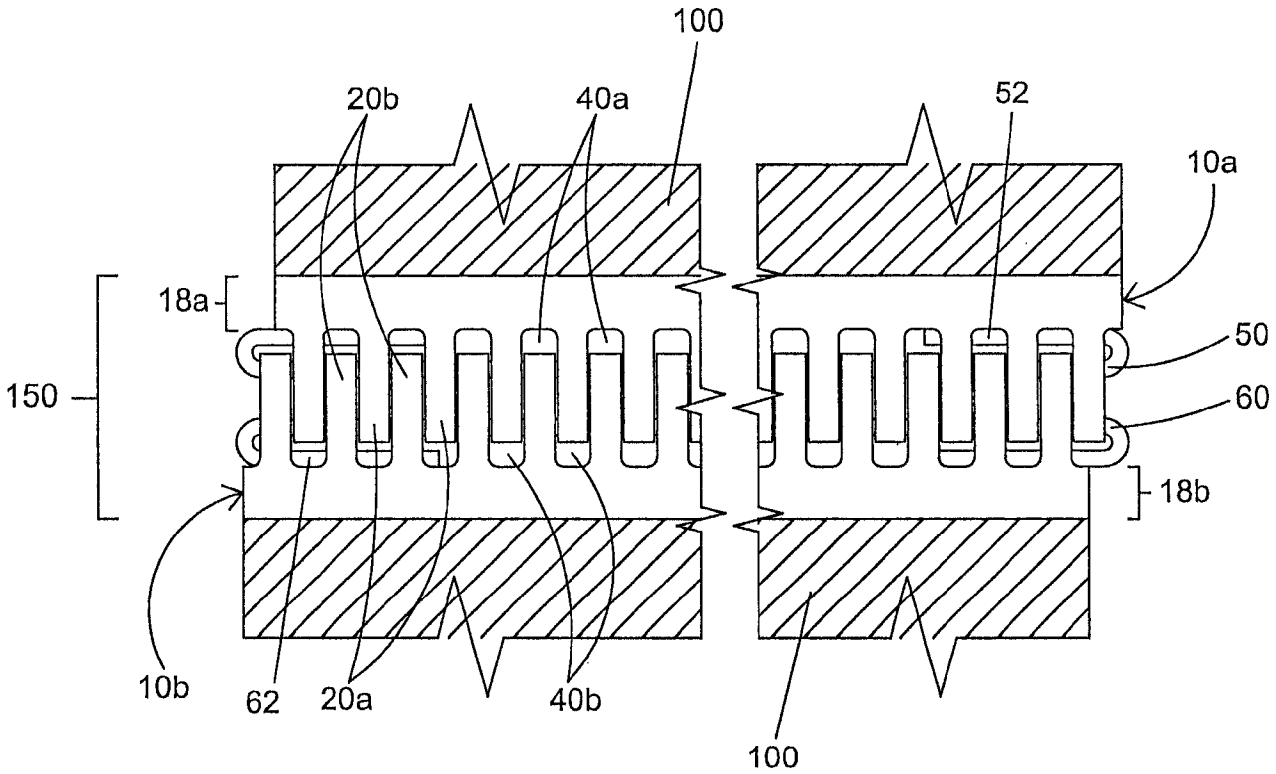
FIG. 8 is a top view of the two joined double pin seaming elements shown in FIG. 7.

Referring now to FIGS. 7 and 8, these are respectively a perspective view and a top view of an assembled pair 150 of seaming elements 10*a*, 10*b* such as shown in FIGS. 1 to 4. FIG. 7 shows the seaming elements joined to each other, and FIG. 8 shows them as also attached to fabric 100. Protrusions 20*a* are interdigitated between protrusions 20*b*, in spaces 40*b*, 40*a* respectively, and first and second channels 26, 36 are formed in the manner previously described to receive pintles 50, 60 and their respective pintle tails 52, 62. Fabric 100 (FIG. 8) is attached to seaming elements 10*a*, 10*b* by suitable means, such as in the manner shown in FIG. 3.

Figure 9:
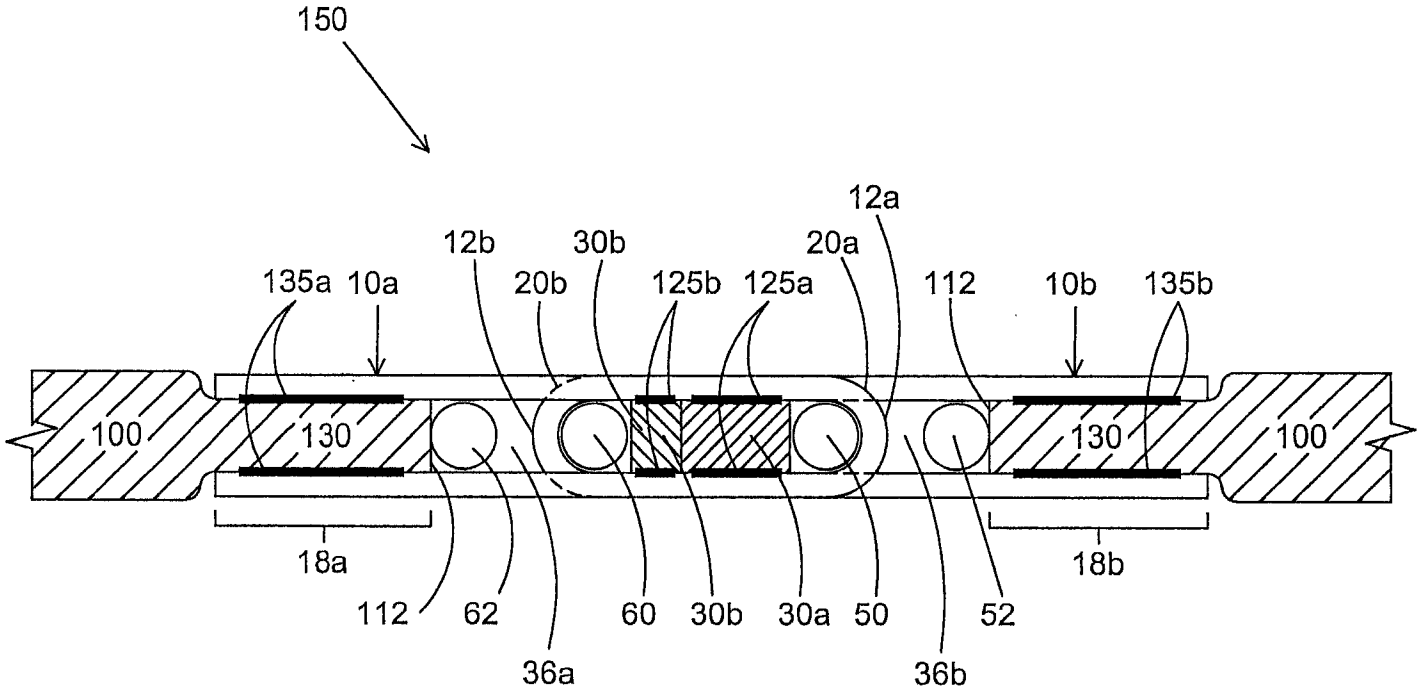
FIG. 9 is a side view of the joined double pin seaming elements shown in FIG. 8.

FIG. 9 is a side view of the assembled pair 150 of seaming elements 10*a* and 10*b* and continuous fabric 100 as shown in FIG. 8. Ribs 30*a* are bonded to seaming element 10*a* at bond regions 125*a*, and ribs 30*b* are bonded to seaming element 10*b* at bond regions 125*b*. Similarly, seaming element 10*a* is bonded to fabric 100 at bond regions 135*a*, and seaming element 10*b* is bonded to fabric 100 at bond regions 135*b*. Protrusions 20*a*, 20*b* are interdigitated to provide channels through which pintles 50, 60 are inserted, and pintle tails 52, 62 are inserted in spaces 36*b*, 36*a* respectively.

Figure 10:
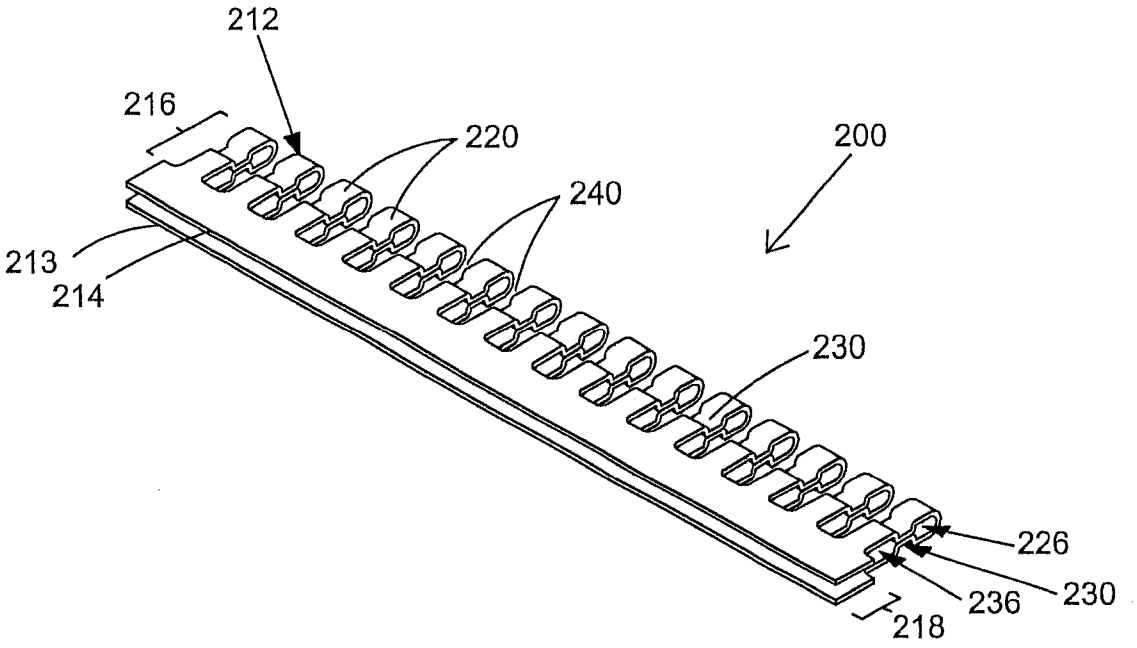
FIG. 10 is a perspective view of a second embodiment of the double pin seaming element.
Figure 11:
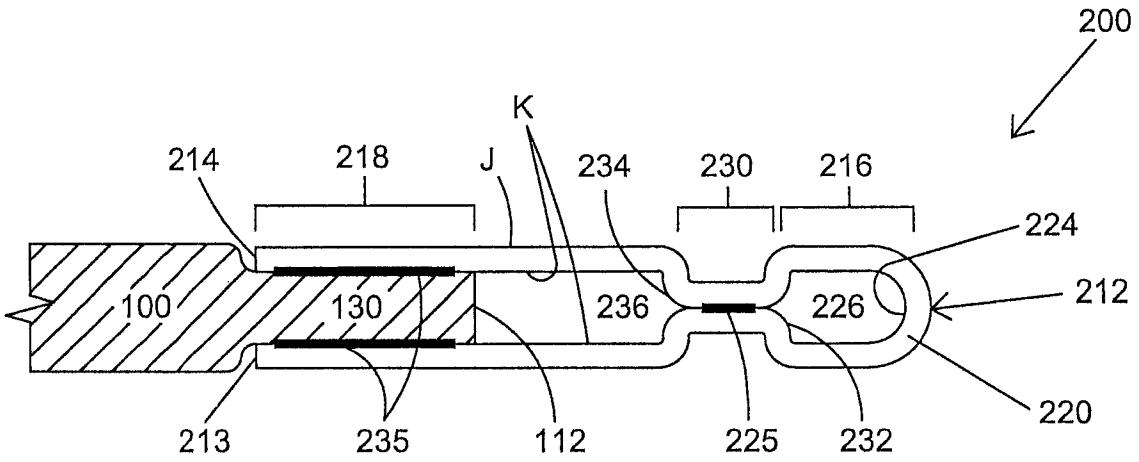
FIG. 11 is a side view of the double pin seaming element shown in FIG. 10.
Figure 12:
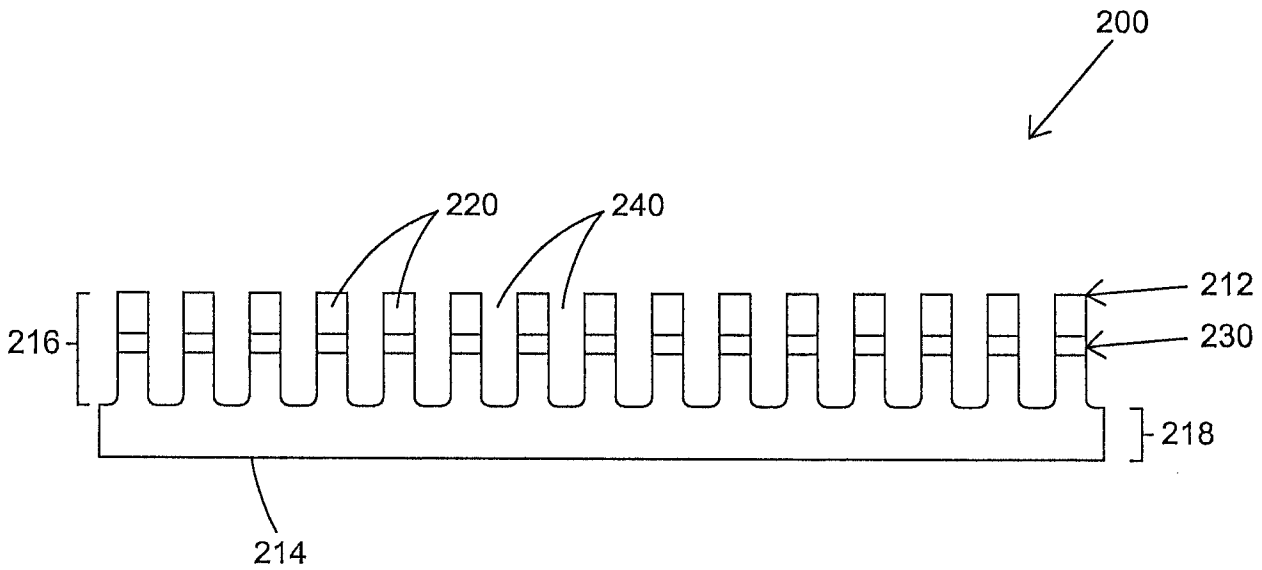
FIG. 12 is a top view of the double pin seaming element shown in FIG. 10.

Referring now to FIGS. 10 to 12, these show a second embodiment of the double pin seaming element, in perspective, side view and top view respectively. Seaming element 200 comprises forward (second) region 216, rear (first) region 218, upper trailing edge 214 and lower trailing edge 213. Protrusions 220, extending to fold line 212 and separated by apertures 240, each have constriction zone 230, formed from ridges in the upper and lower layer of protrusions 220. As best seen from FIG. 11, constriction zone 230 provides a limiting means between the outer securing region including first channel 226 and the inner securing region including second channel 236. Channel 226 is defined by inner surface 224 of loops of protrusions 220, and leading surface 232 of constriction zone 230. Second channel 236 is defined by inner surfaces K of protrusions 220, trailing surface 234 of constriction zone 230, and leading surface 112 of compressed region 130 of fabric 100. The ridges forming constriction zone 230 are bonded to each other at bond region 225. Compressed region 130 of fabric 100 is attached to seaming element 200 by bonding at bond regions 235.

Figure 13:
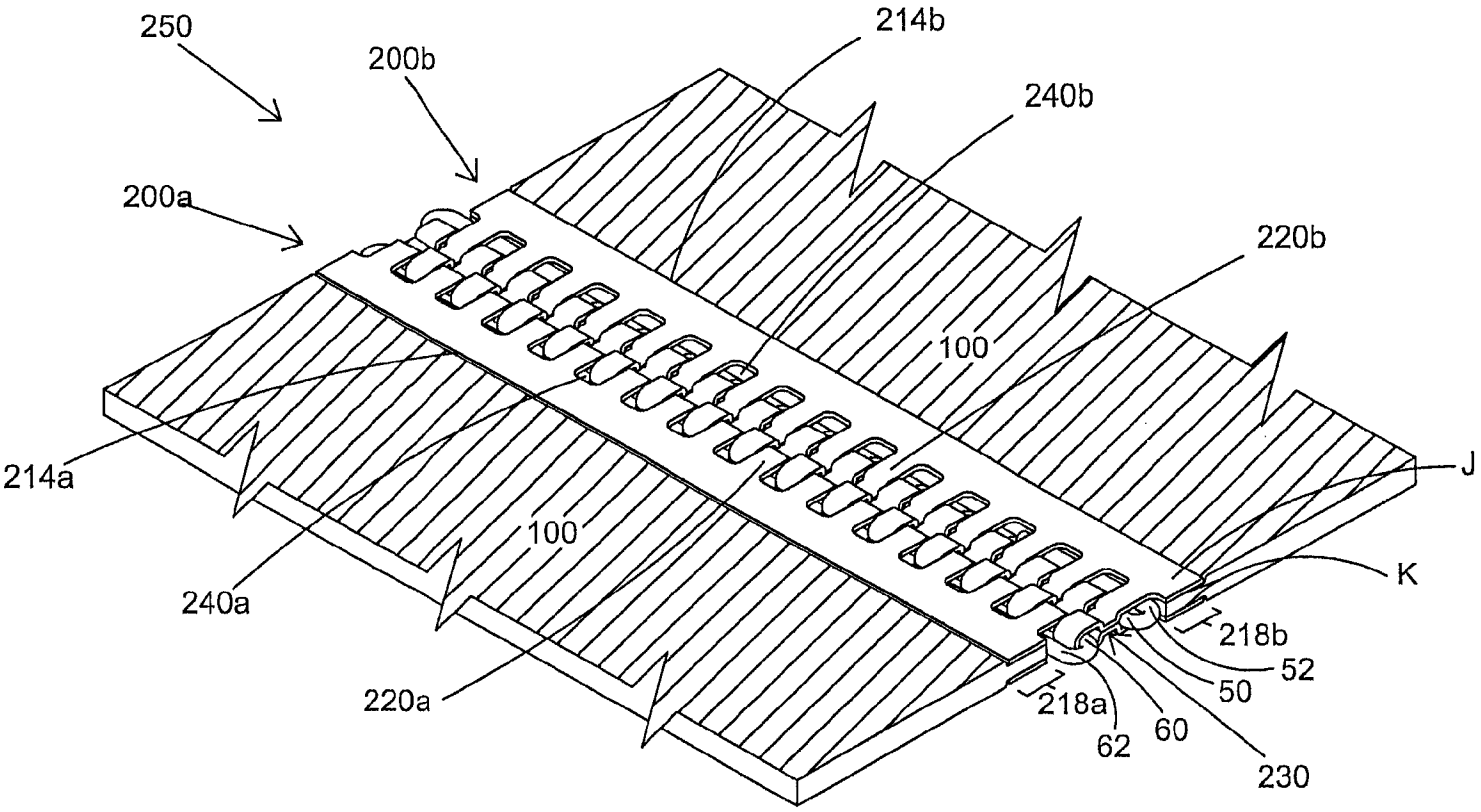
FIG. 13 is a perspective view of a pair of double pin seaming elements as in FIGS. 10 to 12.
Figure 14:
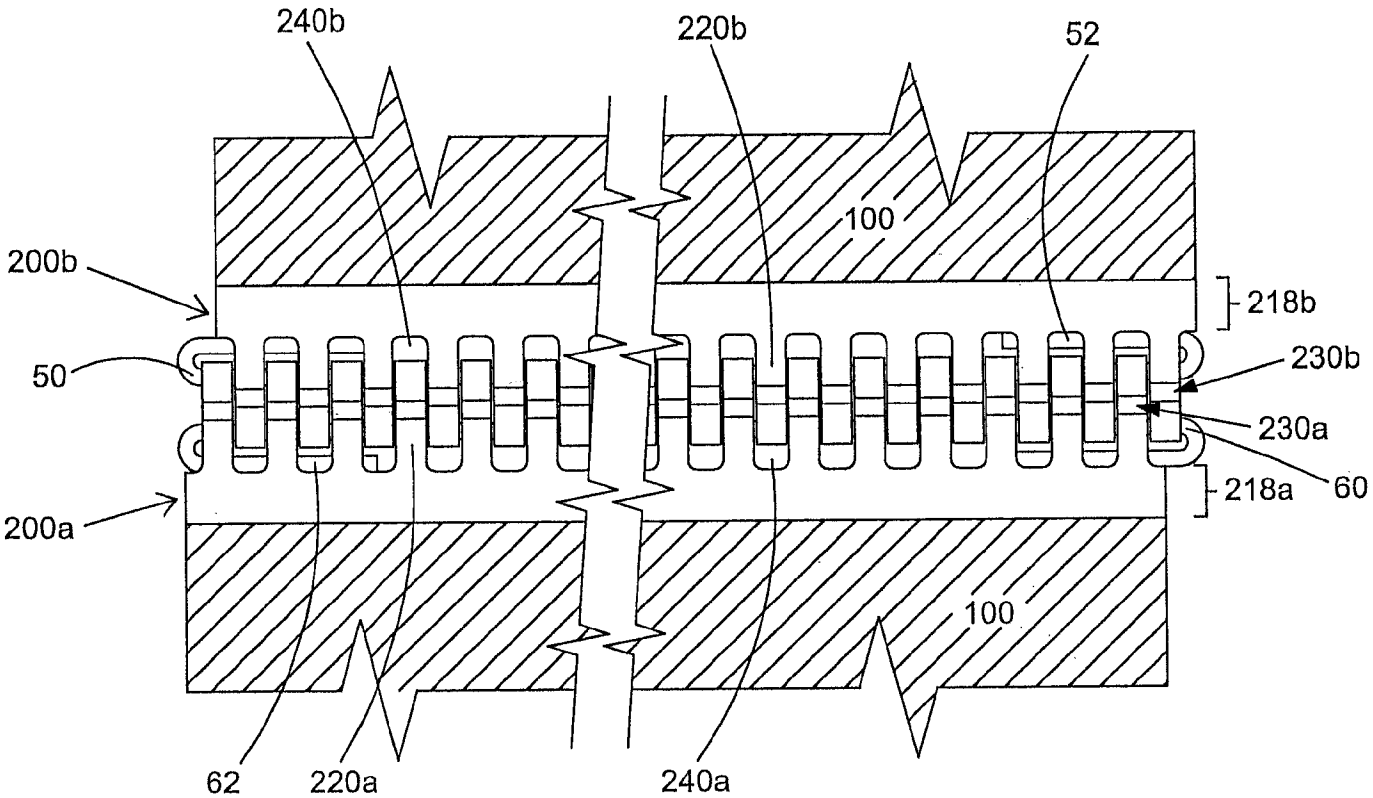
FIG. 14 is a top view of the two joined double pin seaming elements shown in FIG. 13.
Figure 15:
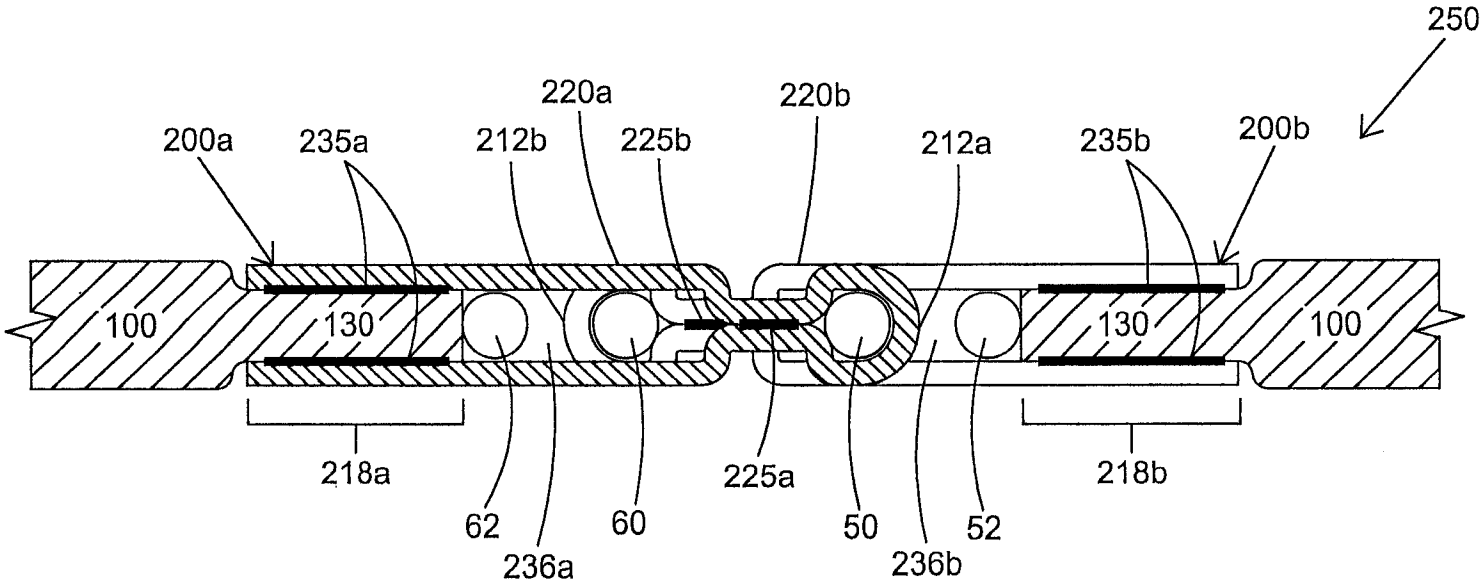
FIG. 15 is a side view of the two joined double pin seaming elements shown in FIG. 13.
Figure 16:
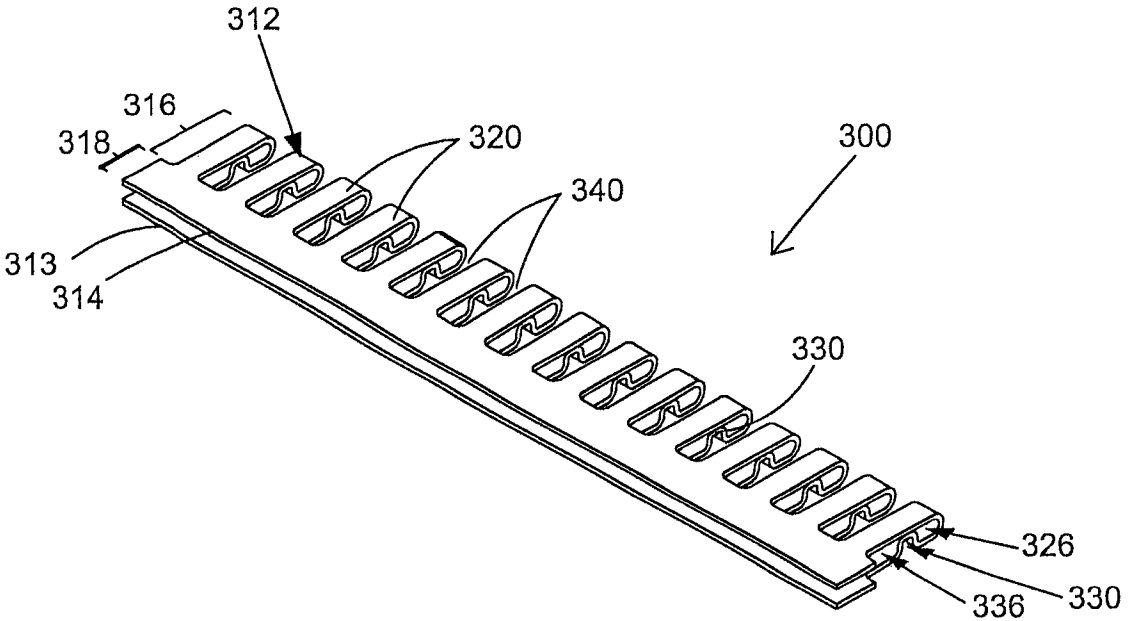
FIG. 16 is a perspective view of a third embodiment of a double pin seaming element.
Figure 17:
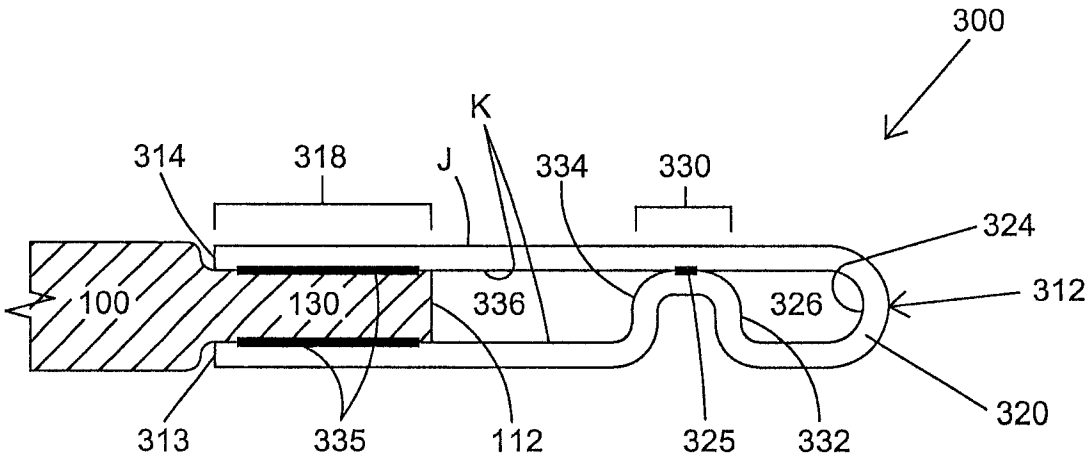
FIG. 17 is a side view of the double pin seaming element shown in FIG. 16.
Figure 18:
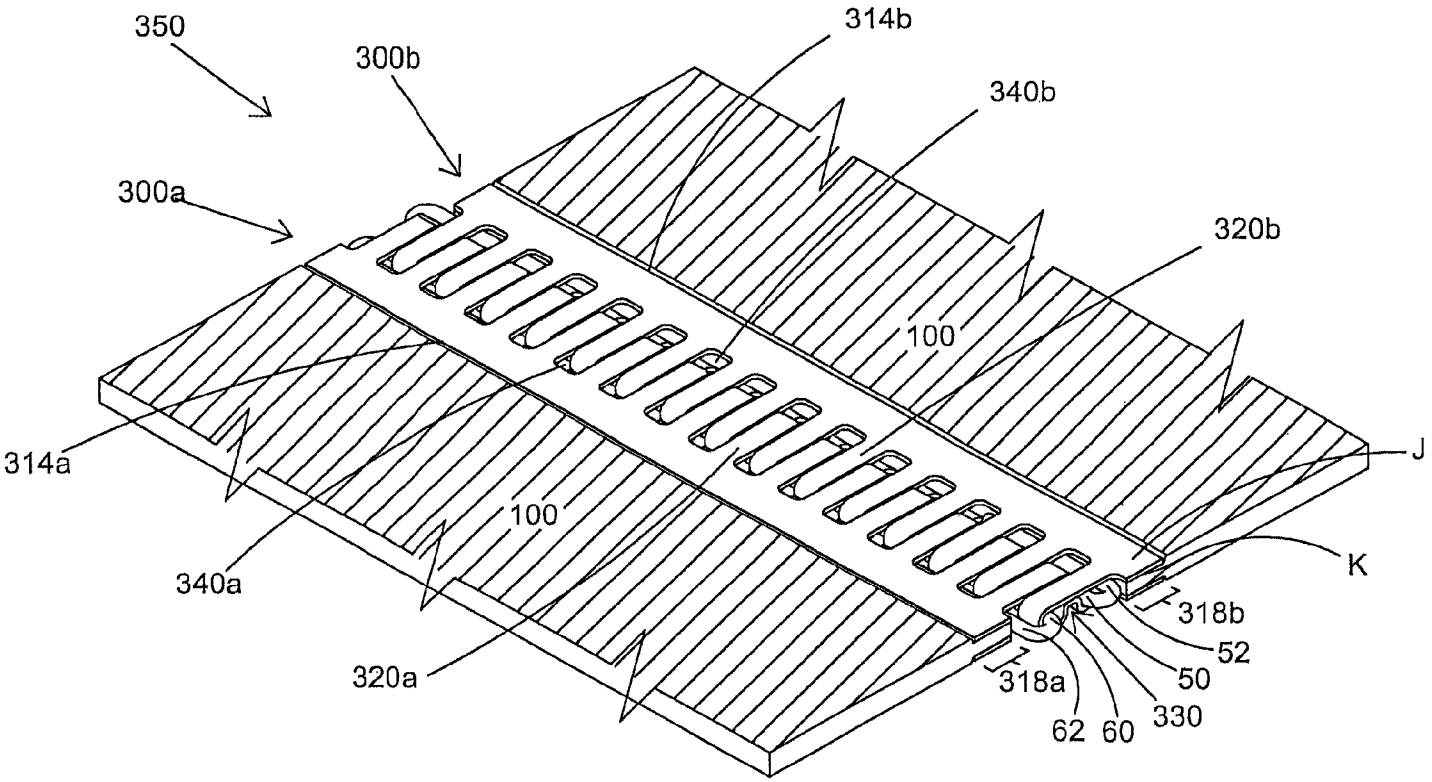
FIG. 18 is a perspective view of a pair of double pin seaming elements as shown in FIGS. 16 and 17.
Figure 19:
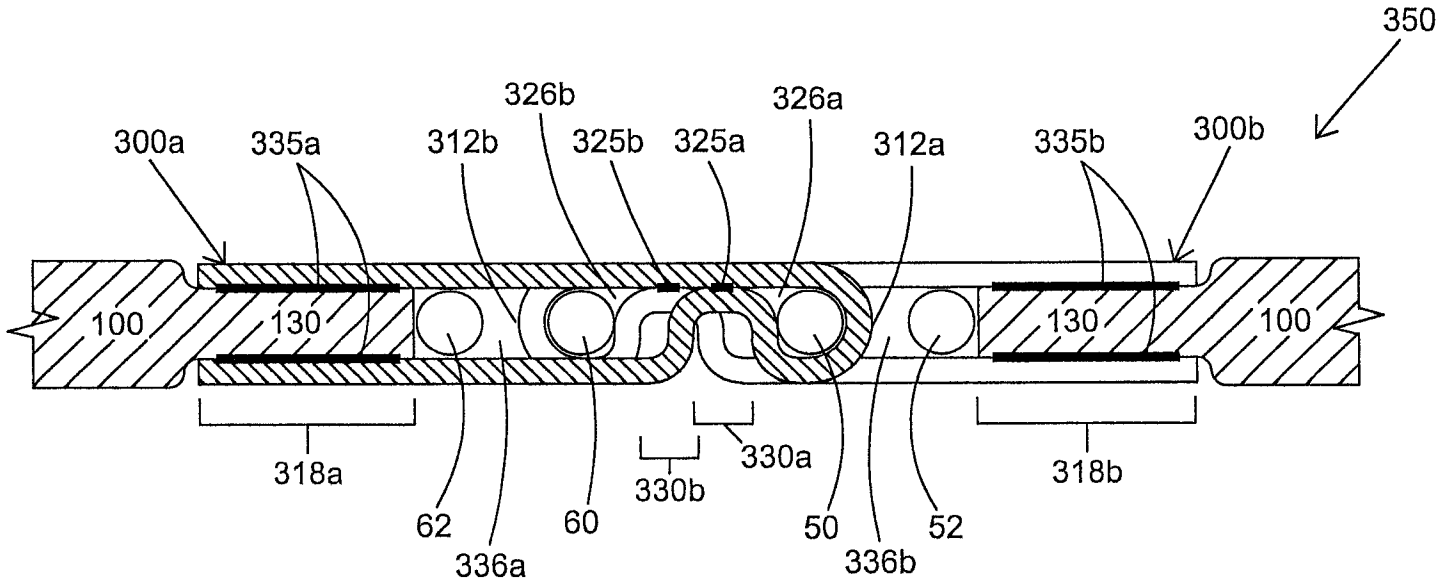
FIG. 19 is a side view of the two joined double pin seaming elements shown in FIG. 18.

Referring now to FIGS. 13 to 15, these are a perspective view, a top view and a side view respectively of assembly 250 of seaming elements 200*a*, 200*b* as shown in FIGS. 10 to 12, which have been attached to fabric 100 and joined to each other. Protrusions 220*a*, 220*b* are interdigitated to provide first and second channels through which pintles 50, 60 are inserted, and pintle tails 52, 62 are inserted in second channels 236*b*, 236*a* respectively.

Referring now to FIGS. 16 to 19, these show seaming elements in a third embodiment. In this embodiment, similarly to the embodiment shown in FIGS. 10 to 15, seaming element 300 comprises forward (second) region 316, rear (first) region 318, upper trailing edge 314 and lower trailing edge 313. Protrusions 320 extend from rear (first) region 318 to fold line 312. However, the upper layer of each of protrusions 320 is planar, and constriction zone 330 is provided by a ridge in only the lower layer of protrusions 320, to provide an outer securing region including first channel 326 and an inner securing region including second channel 336. Referring to the side view of FIG. 17, constriction zone 330 is bonded at bond region 325, and compressed region 130 of fabric 100 is attached to seaming element 300 at rear region 318 by bonding at bond regions 335. First channel 326 is defined by inner surface 324 to loops of protrusions 320 and leading surface 332 of constriction zone 330; and second channel 336 is defined by trailing surface 334 of constriction zone 330, inner surfaces K of protrusions 320, and leading surface 112 of compressed region 130 of fabric 100. Referring to the perspective view of FIG. 18, and the side view of FIG. 19, these show assembly 350 of seaming elements 320*a*, 320*b* with fabric 100, after insertion of pintles 50, 60 into channels 326*a*, 326*b* of each outer securing region respectively, and pintle tails 52, 62 into second channels 336*b*, 336*a* of each inner securing region respectively of the two seaming elements.

For the embodiments shown in FIGS. 1 to 9, the bonding of the ribs to the inner surfaces of the protrusions, and the bonding of the element to the fabric body, can be by any suitable means, such as welding or application of adhesives, but laser welding is particularly suitable.

For the embodiments shown in FIGS. 10 to 19, the ridges can be constructed by any suitable means, using heat and pressure as appropriate; but roll forming has been found to be particularly suitable.

CONCLUSION

The foregoing has constituted a description of specific embodiments showing how the double pin seaming element may be applied and put into use. These embodiments are only exemplary. The double pin seaming element in its broadest, and more specific aspects, is further described and defined in the claims which now follow.

These claims, and the language used therein, are to be understood in terms of the variants of the double pin seaming element which have been described. They are not to be restricted to such variants, but are to be read as covering the full scope of the double pin seaming element as defined in the claims that now follow.

The invention claimed is:

1. A seaming element for seaming a first seamable edge region of an industrial textile to a second seamable edge region of the industrial textile, the seaming element constructed from a single layer of polymeric film folded to provide a fold region and parallel arms that comprise a first region, the seaming element further comprising a second region, (i) the first region is constructed and arranged to be bonded to a first and second surface of the first seamable edge region; and (ii) the second region comprises a plurality of spaced-apart aligned protrusions extending from the first region, each protrusion comprising an interior space defined by an upper layer; a lower layer; and a loop at the fold region that connects the upper and lower layers;

wherein:

(A) the interior space is divided into an outer securing region and an inner securing region by one of: a) a rib member placed between and bonded to an inner surface of at least one of the upper and lower layer such that the inner securing region is between the rib member and the first region and the rib member is distinct from the first region; and by b) bonding a portion of the upper layer with a portion of the lower layer at a constriction zone; with the outer securing region defined in part by an inner surface of the loop;

(B) the outer securing region is interdigitatable and alignable with the inner securing region of a corresponding second seaming element bonded to the second seamable edge region of the textile, to define a first channel; and (C) the inner securing region is interdigitatable and alignable with the outer securing region of the corresponding second seaming element, to define a second channel.

2. The seaming element according to claim 1, wherein the interior space is divided by the rib member bonded to the inner surface of the upper layer and the inner surface of the lower layer.

3. The seaming element according to claim 2, wherein the rib member is bonded by a process selected from laser welding and adhesive bonding.

4. The seaming element according to claim 1, wherein the interior space is divided by the constriction zone, with the constriction zone comprising at least one ridge on an inner surface of at least one of the upper layer and the lower layer.

5. The seaming element according to claim 4, wherein the at least one ridge is bonded to the opposing layer by a process selected from laser welding and adhesive bonding.

6. The seaming element according to claim 1, wherein each of the first and second channels is constructed and arranged to receive a securing means.

7. The seaming element according to claim 1, wherein the polymeric film comprises a thermoplastic polymer or a thermoset polymer.

8. The seaming element according to claim 7, wherein the polymeric film is a theremoplastic polymer selected from the group consisting of polyethylene terephthalate (PET), polybutylene terephthalate (PBT), polyethylene naphthalate (PEN), poly(cyclohexylene dimethylene terephthalate), acid (PCTA), polyphenylene sulphide (PPS), polyetheretherketone (PEEK), polysulfone and polyamide.

9. The seaming element according to claim 8, wherein the thermoplastic polymer is PET.

10. The seaming element according to claim 8, wherein the polymeric film comprises a laser energy absorbing dye or laser weldable component.

11. The seaming element according to claim 8, wherein the polymeric film is biaxially oriented and is a bicomponent PET film comprising a laser weldable layer.

12. The seaming element according to claim 8, wherein the first region is laser welded to the industrial textile.

13. The seaming element according to claim 1, wherein the industrial textile is one of a woven or nonwoven textile, the first and second seamable edge regions each comprise a compressed textile region, and the first region of the seaming element is constructed and arranged to be bonded to portions of a first and second outer surface of the compressed textile region.

14. An industrial textile comprising at least one pair of seaming elements, each constructed according to claim 1.

15. A seaming element for seaming a first seamable edge region of an industrial textile to a second seamable edge region of the industrial textile, the seaming element constructed from a single layer of biaxially-oriented thermoplastic polymeric film folded in a general U-shape to provide a fold region and parallel arms that comprise a first region, the seaming element further comprising a second region, (i) the first region is constructed and arranged to be bonded to a first and second surface of the first seamable edge region; and (ii) the second region comprises a plurality of spaced-apart aligned protrusions extending from the first region , each protrusion comprising an interior space defined by an upper layer; a lower layer; and a loop at the fold region that connects the upper and lower layers;

wherein:

(A) the interior space is divided into an outer securing region and an inner securing region by one of: a) a rib member placed between and bonded to an inner surface of at least one of the upper and lower layer such that the inner securing region is between the rib member and the first region and the rib member is distinct from the first region; and by b) bonding a portion of the upper layer with a portion of the lower layer at a constriction zone; the outer securing region defined in part by an inner surface of the loop;

(B) the outer securing region is interdigitatable and alignable with the inner securing region of a corresponding second seaming element bonded to the second seamable edge region of the textile, to define a first channel; and (C) the inner securing region is interdigitatable and alignable with the outer securing region of the corresponding second seaming element, to define a second channel.

16. The seaming element according to claim 15, wherein the biaxially oriented film is a bicomponent PET film comprising a laser weldable layer.

* * * * *